United States Patent [19]

Oda

[11] 4,071,928

[45] Feb. 7, 1978

[54] SLIDER FOR A CONCEALED SLIDE FASTENER

[75] Inventor: Kiyoshi Oda, Kurobe, Japan

[73] Assignee: Yoshida Kogyo K.K., Japan

[21] Appl. No.: 735,053

[22] Filed: Oct. 22, 1976

[30] Foreign Application Priority Data

Oct. 31, 1975 Japan ..... 50-149841[U]

[51] Int. Cl.[2] ..... A44B 19/26

[52] U.S. Cl. ..... 24/205.1 R; 24/205.15 R; 24/205.14 A

[58] Field of Search ..... 24/205.1 R, 205.15 R, 24/205.14 A

[56] References Cited

U.S. PATENT DOCUMENTS

| | | | |
|---|---|---|---|
| 3,284,864 | 11/1966 | Howell | 24/205.1 R |
| 3,516,127 | 6/1970 | Howell | 24/205.1 R |
| 3,798,715 | 3/1974 | Moertel | 24/205.1 R |
| 3,854,175 | 12/1974 | Yoshida | 24/205.1 R |

*Primary Examiner*—Bernard A. Gelak
*Attorney, Agent, or Firm*—Bucknam and Archer

[57] ABSTRACT

A slider for a concealed slide fastener comprises a body including a flared front end and a contracted rear end, and having a bottom wall, a pair of side flanges formed on the bottom wall, and a pair of inturned lips extending from the side flanges. A element guide island is formed centrally on the bottom wall near the flared front end and cooperates with the side flanges in providing a substantially Y-shaped guide channel for the passage therethrough of a pair of rows of interlocking fastener elements. A support lug is provided on the island, and a pull tab is pivotally supported on the lug. The pull tab is rectangular and has at one end an aperture, bifurcations bounding the aperture, and a pintle connecting the bifurcations together and passing through a hole formed in the lug. The bifurcations have extensions held in engagement with the sides of said support lug. A pull tab rest is provided on the island and has a top surface sloped downwardly toward the front end of the island, the pull tab being engageable flatwise with the top surface of the pull tab rest when the pull tab is pivoted about the lug downwardly toward the flared front end.

6 Claims, 5 Drawing Figures

SLIDER FOR A CONCEALED SLIDE FASTENER

BACKGROUND OF THE INVENTION

1. Field of the Invention

The present invention relates to a slider for a concealed or hidden type slide fastener.

2. Prior Art

When closed by a slider, a slide fastener of the concealed type masks the fastener elements and slider from external view, only leaving a linear seam in the junction of the opposed stringer tapes. Such slightly fasteners can be used particularly in openably closing slits formed in the back panels of garments and in the lower parts of garment sleeves.

With this type of slide fastener, the pull tab connected to the slider projects and hangs down outside of the garment to which the slide fastener is attached. This has led to the drawback that the pull tab tends to be caught by foreign objects or to be pressed against the wearer's body, with the results that the foreign objects and the garment can be damaged, or the wearer's body can be injured. The protruding pull tab lessens a pleasing appearance inherent in the concealed slide fastener, especially when the fastener is used on the back panels of the garments.

SUMMARY OF THE INVENTION

Accordingly, it is a primary object of the present invention to provide a concealed slide fastener slider having a pull tab locatable stably in place when not in use.

Another object of the present invention is to provide a concealed slide fastener slider with its pull tab concealable from external view and preventable from projecting outside of a fastener-attached garment, when not in use.

Still another object of the present invention is to provide a concealed slide fastener slider that can make an overall garment appearance more slightly and renders itself less harmful.

According to the present invention, a pull tab rest is formed on an element guide island on a bottom wall of a slider body. The rest has a top surface sloped downwardly toward the front end of the element guide island. When the pull tab is pivoted downwardly toward the flared front end of the slider body, the pull tab is engageable flatwise with the sloped top surface of the pull tab rest. The pull tab has a pair of extensions from bifurcations bounding an aperture formed in the pull tab at one end, the extensions being held in frictional engagement with the sides of a pull tab support lug. A modification comprises leaf springs spanning over recesses formed in the element guide island, the pull tab extensions being bent and held in engagement with the leaf springs when the pull tab is placed on the rest.

The above and other objects, features, and advantages will become more apparent from the following description when taken in conjunction with the accompanying drawing.

DETAILED DESCRIPTION OF THE PREFERRED EMBODIMENTS

Figure 1:
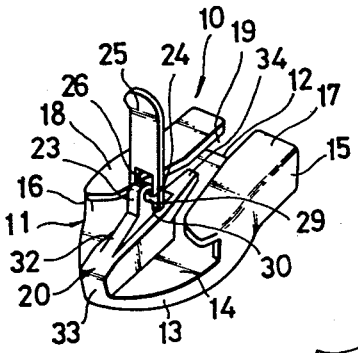
FIG. 1 is a perspective view of a slider constructed in accordance with the present invention.
Figure 2:
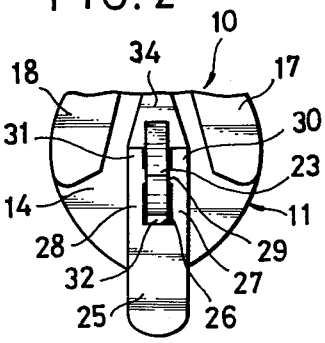
FIG. 2 is a fragmentary plan view of a flared half portion of the slider with its pull tab laid down.

In FIGS. 1 and 2, a slider 10 for a concealed or hidden type slide fastener comprises a body 11 having a contracted rear end 12 at which a pair of coupled rows of elements are moved into and out of the slider body 11, and a flared front end 13 at which a pair of uncoupled rows of elements are moved into and out of the slider body 11. The slider body 11 includes a bottom panel or wall 14 and a pair of side walls or flanges 15,16 formed on and extending perpendicularly from side edges of the bottom wall 14. A pair of inwardly directed or inturned lips 17,18 are formed along the top edges of the sides flanges 15,16, respectively, the inturned lips extending therefrom toward and terminating short of each other with small clearance or space 19 left therebetween.

An elongated island 20 for guiding or separating fastener element rows 21,22 (FIG. 3) is formed centrally on the slider body 11 near the flared front end 13 thereof. The element guide island 20 and the side flanges 15,16 thus jointly provide a generally Y-shaped guide channel for the passage therethrough of the rows of interlocking fastener elements.

The element guide island 20 has on its top surface an upstanding support lug 23 having a hole 24 formed transversely therethrough. The support lug 23 has a width narrower than that of the element guide island 20. A pull tab 25 is a substantially rectangular piece having an aperture 26 located adjacent to one end and bounded by bifurcations 27,28. The pull tab 25 is coupled with and pivotally supported on the support lug 23 by a pintle 29 connecting the bifurcations 27,28 together at the end of the tab 25 and passing through the hole 24 in the lug 28. An upper arcuate portion of the lug 23 is split for the passage of the pull tab pintle 29 and, after the pintle 29 is assembled, is closed off. The free end of the pull tab 25 is rounded and is curved slightly toward the flared front end 13 of the slider body 11. The bifurcations 27,28 have a pair of respective extentions 30,31 which extend beyond the pintle 29 and are wider than the bifurcations 27,28.

The support lug 23 is situated back from the format end 13 of the element guide island 20 to provide on the island 20 a pull tab rest 32 extending between the support lug 23 and the front end 33 of the island 20. The top surface of the pull tab rest 32 is downgrade or is sloped downwardly toward the island front end 33. The angle of inclination of the top surface of the rest 32 is such that when the pull tab 25 is pivoted about the pintle-supporting lug 23 downwardly toward the flared front end 13 of the slider body 11, and when a then downwardly facing surface of the pull tab 25 is brought into intimate flatwise engagement with the top surface of the pull tab rest 32, the pull tab 25 is located downwardly of the outer surface of a garment (FIG. 4).

The extensions 30,31 are so dimensioned as to cause the inner sides thereof to be held in engagement with the sides of the support lug 23, so that the pull tab 25 can be prevented from lateral wobbling movement. The pull tab 25 is substantially equal in width to the element guide island 20 in order to put the sides of the pull tab 25 in alignment with the sides of the island 20. Extending rearwardly from the element guide island 20 is an element presser 34 located centrally between the inturned lips 17,18 or in the clearance 19. The element presser 34 serves to press the fastener elements that are intermeshed in succession against the bottom wall 14 to insure positive interengagement between the opposed element rows.

Figure 3:
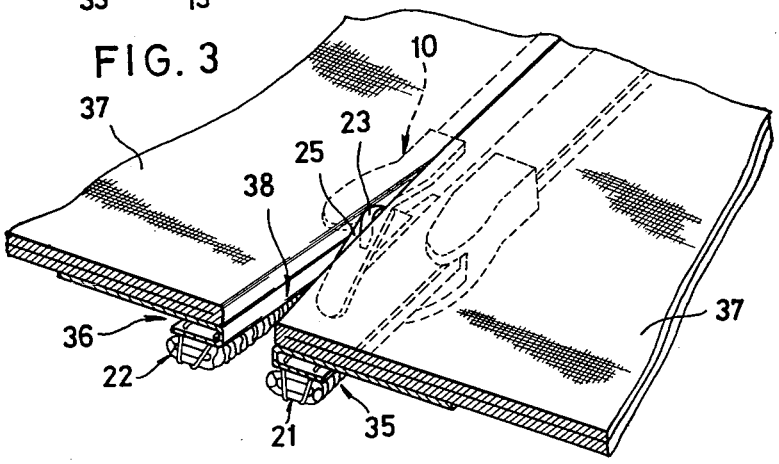
FIG. 3 is a perspective view of a pair of garment margins brought together by closing a concealed slide fastener, the slider being shown in phantom and the pull tab being held in its lowered position.
Figure 4:
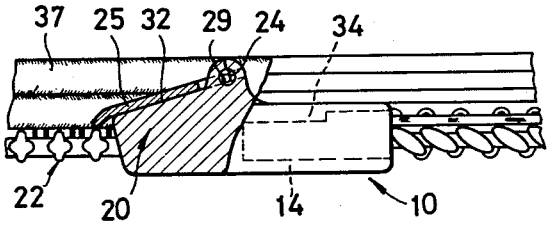
FIG. 4 is a side elevational view, partly cut away, of the slider shown in FIG. 3.

As shown in FIGS. 3 and 4, the slider 10 is used on a pair of concealed fastener stringers 35,36 attached to marginal edges of a garment 37 that bound a slit 38 to be closed and opened. In order to close the slit 38, the slider 10 is moved by pulling the pull tab 25 up to the fastener closing position such as shown in FIG. 3, whereupon the pull tab 25 is pivoted about the pull tab support lug 23 down into abutting engagement with the sloped top surface of the pull tab 32. At this time, the pull tab 25 is located downwardly of the surface of the garment fabric and is hidden from external view. The engagement of the pull tab extensions 30,31 with the sides of the support lug 23 prevents the pull tab 25 from rising away from the pull tab rest 32 beyond the garment surface. The rounded and curved end of the pull tab 25 makes it easy to shove in the pull tab between the marginal edges of the garment 37. In order to open the slit 38, the pull tab 25 sunk in between the garment marginal edges is pried up and is pulled to bring the slider 10 down to the fastener opening position.

Figure 5:
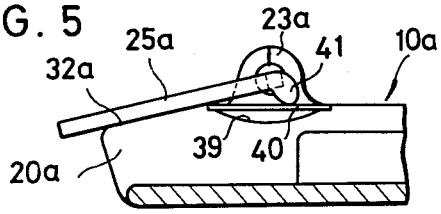
FIG. 5 is a fragmentary vertical cross-sectional view of a modified slider.

A modified slider **10*a* illustrated in FIG. 5 has a pair of recesses 39, only one of them herein shown, formed in an element guide island 20*a* provided one on each side of the pull tab support lug 23*a*. A leaf spring 40 spans over each recess 39 and lies substantially flush with the top surface of the element guide island 20*a*. A pull tab 25*a* includes a pair of bifurcation extensions 41, also only one of them herein shown, each bent into resting engagement with the leaf spring 40 when the pull tab 25*a* is placed on a rest 32*a*. The angle of inclination of the extensions 41 with respect to the pull tab body is such that, as the pull tab 25*a* is raised away from the rest 32*a*, the bent extensions 41 are frictionally pressed against the leaf springs 40 which in turn are forcibly flexed downwardly into the recesses 39. With this structure, the pull tab 25*a* can be prevented also under the resilliency of the leaf springs 40 from getting up and protruding out beyond the surface of the garment 37**.

While particular embodiments of the present invention have been shown and described, it is to be understood that changes and modifications may be made in the construction and arrangements of the various parts without departing from the scope of the appended claims.

I claim as my invention:

1. A slider for a concealed slide fastener comprising: a body including a flared front end and a contracted rear end, and having a bottom wall, a pair of side flanges formed on said bottom wall, and a pair of inturned lips extending from said side flanges; an element guide island formed centrally on said bottom wall near the flared front end and cooperating with said side flanges in providing a substantially Y-shaped guide channel for the passage therethrough of a pair of rows of interlocking fastener elements, said island extending in the longitudinal direction of the slide fastener: a support lug provided on said island at one end thereof remote from the flared front end; a one-piece pull tab pivotally supported on said lug and having means held in engagement with the sides of said support lug and a pull tab rest provided on said island and having a top surface extending longitudinally from said support lug toward the flared front end of said slider body, said top surface being sloped downwardly toward the front end of said island, said pull tab having a flat surface engageable flatwise with the top surface of said pull tab rest when said pull tab is pivoted about said lug downwardly toward the flared front end.

2. A slider according to claim 1, in which said pull tab is rectangular and has at one end an aperture, bifurcations bounding said aperture, and a pintle connecting said bifurcations together and passing through a hole formed in said lug, said means being extensions from said bifurcations.

3. A slider according to claim 2, said pull tab being equal in width to said element guide island.

4. A slider according to claim 2, said pull tab having the other end rounded, and curved toward the flared front end of said body.

5. A slider according to claim 2, in which said extensions of the pull tab are bent, there being a recess in said support lug and a leaf spring spanning over said recess, and said bent extensions being held in engagement with said leaf spring.

6. A slider according to claim 1, said inturned lips terminating short of each other, and said element guide island having an element presser extending therefrom toward the contracted rear end and located centrally between said inturned lips.

* * * * *